US009824541B2

(12) United States Patent
Haag

(10) Patent No.: US 9,824,541 B2
(45) **Date of Patent: *Nov. 21, 2017**

(54) DRAW POKER WITH OPTION TO WAGER FOR ADDITIONAL REPLACEMENT CARDS

(71) Applicant: David Haag, Las Vegas, NV (US)

(72) Inventor: David Haag, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/952,800

(22) Filed: Nov. 25, 2015

(65) Prior Publication Data

US 2016/0155302 A1 Jun. 2, 2016

Related U.S. Application Data

(63) Continuation of application No. 14/020,816, filed on Sep. 7, 2013, now Pat. No. 9,230,406.

(60) Provisional application No. 61/698,507, filed on Sep. 7, 2012.

(51) Int. Cl.

| | |
|---|---|
| ***A63F 9/24*** | (2006.01) |
| ***G07F 17/32*** | (2006.01) |
| ***A63F 1/00*** | (2006.01) |
| ***A63F 3/00*** | (2006.01) |

(52) U.S. Cl.

CPC ..... *G07F 17/3267* (2013.01); *A63F 1/00* (2013.01); *A63F 3/00157* (2013.01); *G07F 17/326* (2013.01); *G07F 17/3293* (2013.01)

(58) Field of Classification Search

CPC ..... G07F 17/3293; G07F 17/3267

See application file for complete search history.

(56) References Cited

U.S. PATENT DOCUMENTS

| | | | |
|---|---|---|---|
| 5,823,873 | A | 10/1998 | Moody |
| 6,595,520 | B1 | 7/2003 | Richards et al. |
| 2003/0153376 | A1 | 8/2003 | Duhamel |
| 2007/0026920 | A1 | 2/2007 | Flint et al. |
| 2010/0201071 | A1 | 8/2010 | Jones |

*Primary Examiner* — Steve Rowland

(74) *Attorney, Agent, or Firm* — Weide & Miller, Ltd.

(57) ABSTRACT

The player makes a wager to not only play the game but also to determine the total number of possible replacement cards that will be dealt. After dealing of the original cards, the player selects cards in the hand to hold and discard. The player is then dealt replacement cards and the number of cards dealt corresponds to the amount of the wager. If the player wagers more, then the player receives more cards, which in turn results in the player having more cards per card position. The player has the option of using any one of the one or more replacement cards dealt to each card position, to form a best hand from all the possible combinations of the cards such that replacement cards dealt to a particular card position can only be used in the card position to which the card was dealt.

13 Claims, 7 Drawing Sheets

DRAW POKER WITH OPTION TO WAGER FOR ADDITIONAL REPLACEMENT CARDS

1. PRIORITY CLAIM

This application claims priority to U.S. patent application Ser. No. 14/020,816 filed on Sep. 7, 2013 titled Draw Poker with Option to Wager for Additional Replacement Cards, which claims priority to U.S. Provisional Patent Application No. 61/698,507 filed on Sep. 7, 2012, titled Draw Poker with Option to Wager for Additional Replacement Cards.

2. FIELD OF THE INVENTION

The invention relates to games and in particular to a method and apparatus for offering a wagering game allowing a player to wager more to obtain additional cards, which may be combined into a hand to develop a game outcome.

3. BACKGROUND TO THE INVENTION

Traditional video and table poker games are based on achieving the highest hand ranking possible whereby the highest hand ranking generally has the highest value. Typical wagering games, such as five card draw is well known in the gaming arts. In the game of five card draw, a player places a wager and is then dealt five cards. The player then selects any cards they wish to hold, and is then dealt replacement cards for any non-held cards. The resulting poker hand is compared to a pay table to determine if the resulting poker hand is a winning hand or a losing hand.

In traditional five card draw, the player is only able to receive one replacement for each non-held card. This limits the player's ability to receive a winning outcome and limits what the player is able to receive from the machine. As a result, players' hands are often losers and the player rarely gets a high ranking hand. Consequently traditional draw poker provides limited excitement value and does not challenge the player with determine possible winning outcomes.

One proposed solution is a game widely known as triple play poker. This game allows a player to play three hands at once. The first 5 cards are dealt face up as in a traditional game of draw poker. The player then selects which cards to hold, and those cards are automatically held in not only the first hand, but also in two additional hands shown on the screen. These held cards are maintained for the corresponding card position in each additional hand. The player then draws the additional cards and the player obtains three different draws from three different decks to fill in the discarded card locations for each of the displayed hands.

While triple play poker provides an alternative to traditional draw poker and is popular, it has lost its excitement level for many players. In addition, with triple play poker, the held cards are populated into every other displayed hand and dealt cards are only dealt into one hand and may not be used in any other hand. Although this makes it easy to understand, it greatly limits the variation, winning opportunities, and the excitement that could otherwise be achieved.

As a result, there is a need for an improved wagering game which increases win opportunities and options while increasing player excitement and interest.

SUMMARY

The method of the present invention involves a card game in which the player is dealt five cards such as in a traditional game of draw poker allowing the player to play a single hand of five initial cards. The player makes a wager to not only play the game but also to determine the total number of possible replacement cards that can be used for each card, in that cards position, that is to be discarded. There are numerous variations regarding when the cards are dealt in relation to the wager and the amount of the wager and these variations are discussed below. The player is then dealt cards and the number of cards dealt corresponds to the amount of the wager. If the player wagers more, then the player receives more cards, which in turn results in the player having more cards per card position and thus, a greater chance of receiving a winning outcome.

In this embodiment, the player has the option of using any one of the one or more replacement cards, for each card position, after the deal to form their hand. Any possible replacement cards not used may be forfeited. Hence, the player may wager more to 'buy' additional cards in the hope of establishing a better hand rank with the additional cards that are dealt to each card position. Subject to the wager amount, additional replacement cards are dealt to each hand card position which the player selected to discarded cards. The new cards may be shown as stacked up behind the particular card position to which the card is dealt.

In one embodiment, the maximum number of new or replacement cards for each card position is three. In other embodiments, other number of additional cards may be obtained through additional wagers. It is also contemplated that a number of cards other than five cards may be dealt to the player, such as but not limited to 3 cards or 7 cards.

During play, the initial hand is dealt face up. After dealing the initial five cards, if one or more cards are held, then it is assumed that the player believes those held card(s) has/have a better chance of creating the optimum hand than any one of the one or more possible replacement cards at each respective card position. The player selects which cards to hold. New cards are then dealt and displayed to the player. More than one card may be dealt to each card position depending on the amount wagered.

The highest hand possible from the combination of the replacement cards for each card position may be calculated in various ways. In one embodiment, recursion, or other methods, are used to find the optimum combination of cards, such as by the processor and software of the gaming machine. In another embodiment, the player can select one of the one or more possible replacement cards to replace each discarded card at the discarded card position. The highest value hand, which doesn't necessarily correlate to the highest ranking hand, is evaluated and if the hand is a winning outcome based on a pay table, an award is paid to the player.

The present invention allows the player to have the option of selecting one replacement card from one or more replacement cards for each discarded card. It is also contemplated that the gaming machine or computing device executing machine readable code (software), may be configured to select which card to use in the final player hand by picking which card for each card position would yield the highest paying hand (which may or may not be the highest ranking hand).

In addition, it is understood that as more cards are available for replacement of the discarded cards, the highest hand ranking no longer remains associated with the highest value of a traditional poker hand ranking. For example, a hand that is traditionally a lower ranking hand may become a higher ranking hand when numerous cards are available to form the player hand, such as when the player purchases three additional cards for each card position in the hand. This characteristic offers the player a change from the traditional poker strategy by introducing more entertainment and enhanced game play.

Other embodiments of this invention include the card replacement indicators determined by the player instead of determined by the wager. In one embodiment, the player may increase the wager to have an opportunity of choosing from more than one card replacement possibility for a specific card position. The player may continue increasing the wager to increase the opportunity of more card replacement options for additional card positions.

A method of playing a card game is disclosed herein that includes providing a physical deck of playing cards comprising at least a fifty-two card deck and receiving a wager, an amount of the wager determines the total number of replacement cards to replace discarded cards. The game may be placed on a gaming machine. This method of play then deals five original cards to the player and displays the original cards on a display, the original cards displayed at card positions. Then the gaming machine receives an indication from the player regarding which original cards are held and which original cards are discarded. In response, the gaming machine deals replacement cards to replace the discarded original cards, the total number of possible replacement cards controlled by the amount of the wager and the dealing including dealing at least two replacement cards to at least one card position. Then, the resulting hand is analyzed by forming a highest ranking hand from any of the original cards and replacement cards that are displayed on the screen such that only one card from each card position may be selected when forming the highest ranking hand. The method of play then compares the highest ranking hand to a pay table to determine if the highest ranking hand is a winning outcome. If the highest ranking hand is a winning outcome then the gaming machine or other device provides an award to the player.

The step of forming the highest ranking hand may include receiving input from the player regarding which cards to select for the hand, or it may be done by the gaming machine. This method of play may further comprise analyzing the replacement cards to initiate a bonus event responsive to the replacement cards being located at a specific card position. For example, the combination of all visible replacement cards shown at all card positions can initiate a bonus event. It is contemplated that the highest ranking hand may not correlate to the highest value hand in traditional poker ranking. In one embodiment, the highest hand value is determined by the number of suits in the hand, or the total sum of the card values.

A game method is disclosed for playing a game at a gaming machine comprising the machine-implemented steps of receiving a wager, the wager having an amount and dealing and displaying playing cards to a player to create a first card set such that one card is dealt and displayed at each card position. This method of game play then receives input from the player regarding which cards to discard from the card hand and removes from display the discarded cards. The game play method then deals and displays a number of replacement cards to replace discarded cards to create a second card set, such that the number of replacement cards dealt and displayed correspond to the amount of the wager such that multiple cards may be dealt and displayed at each card position. The method of play then calculates a hand rank based on an arrangement of cards that result in the highest possible hand rank based on two or more hand ranks set forth in a pay table. When determining the hand rank, the arrangement of cards that forms the hand includes only one card from each card position. The player is provided an award to the player if the hand rank achieved by the player is a winning hand rank based on the pay table.

In one embodiment, the dealing and displaying cards includes dealing and displaying five cards, such as in a five card draw poker hand. The first card set includes five card positions and one of the five cards is dealt and displayed at each of the five card position. In one embodiment, up to three replacement cards may be dealt to each card position to replace discarded cards. For example, each wager amount is a credit and each credit wagered results in one replacement card being dealt. In one configuration, the highest possible hand rank is based on traditional poker hand ranks. In one embodiment the method further comprises analyzing the replacement cards to determine if the replacement cards result in a bonus outcome and if the replacement cards result in a bonus outcome, providing a bonus award to the player.

To enable and provide the gaming method disclosed herein, a gaming machine may be provided which includes a controller, at least one electronic display, at least one player input device, and a memory storing machine-readable code. The controller may be a processor. The machine-readable code is executable by the controller to offer the game to the player. The machine readable code is configured to, in connection with the gaming machine, receive a wager such that an amount of the wager determines the total number of replacement cards to replace discarded cards. The machine readable code is configured to deal five original cards to the player and display the original cards on the display. The original cards are displayed at card positions. The machine readable code is configured to receive an indication from the player regarding which original cards are held and which original cards are discarded, and then deal replacement cards to replace the discarded original cards. The total number of possible replacement cards is controlled by the amount of the wager and dealing includes dealing at least two replacement cards to at least one card position. Then, the machine readable code is configured to form a highest ranking hand from any of the held original cards and replacement cards displayed on the screen such that only one card from each card position may be selected when forming the highest ranking hand. The machine readable code is then configured to compare the highest ranking hand to a pay table to determine if the highest ranking hand is a winning outcome. If the highest ranking hand is a winning outcome then the machine readable code is configured to provide an award to the player.

Forming the highest ranking hand includes receiving input from the player regarding which cards to select for the hand, or this process may be done by the gaming machine, such as a processor within the gaming machine. This method may further comprise analyzing the replacement cards to initiate a bonus event responsive to the replacement cards being located at a specific card position. For example, the combination of all visible replacement cards shown at all card positions can initiate a bonus event. It is contemplated that the highest ranking hand may not correlate to the highest value hand in traditional poker ranking. In one embodiment, the highest hand value is determined by the number of suits in the hand, or the total sum of the card values.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

The present invention includes several embodiments of a method for playing a poker game, preferably on a video gaming machine as shown below in FIG. 8. In a preferred embodiment the underlying video poker games are presented in traditional format using one or more standard 52 card decks (13 cards of A, K, Q, J, 10, 9, 8, 7, 6, 5, 4, 3, and 2, in each of the suits of Hearts, Diamonds, Clubs and Spades). Of course, other decks of cards (such as including bonus or wild cards, etc.) might be used. During game play one or more wagers are made. As is known, the wager preferably comprises monies (coins, paper currency) or monetary equivalent (such as chips or credits). Of course, the form of the wager and how it is presented and accepted may vary. For example, if the game is presented at a table using physical cards, the player may place the wager using chips. If the game is presented at an electronic gaming machine, the player may place the wager by providing monetary value to the gaming machine and then wagering one or more credits. Of course, other forms of wagers may be utilized including points, free games, etc.

Figure 1:
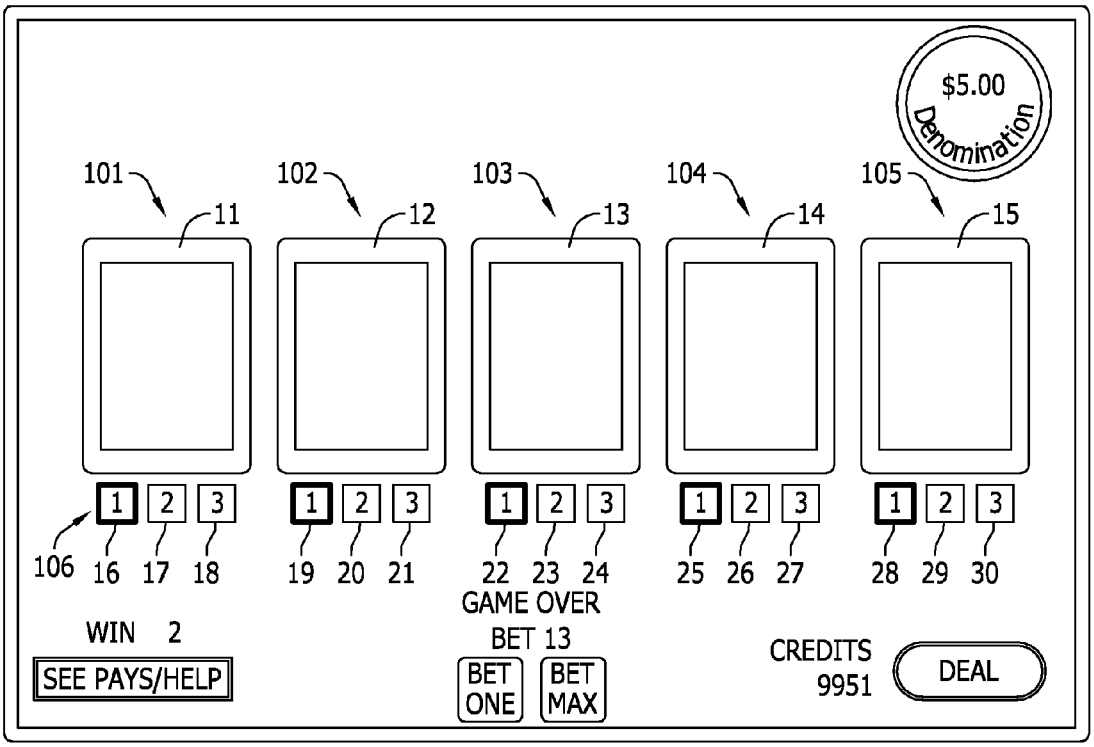
FIG. 1 shows the present invention before the initial deal of the cards.

Referring to FIG. 1, a single row of five cards 11, 12, 13, 14, 15 is shown face down. This is how the cards may initially be dealt. For purposes of discussion, card positions are defined from left to right as card position 101, 102, 103, 104, and 105. The card positions indicate the position of each card in relation to the other cards in the hand. Shown along the bottom of the cards 11, 12, 13, 14, 15 are card replacement indicators 106. The replacement indicators 106 are shown with black background or a light back depending on whether a wager has been made to receive a replacement card. In this embodiment, the player may wager additional amounts to obtain additional cards, up to three for each card position. As a result, three replacement indicators are shown below each card. The replacement indicators are shown by element numbers 16, 17, 18, 19, 20, 21, 22, 23, 24, 25, 26, 27, 28, 29, 30. In other embodiments, the replacement indicators may be located at locations other than below the cards.

For purpose of discussion the first five cards 11, 12, 13, 14, 15 that are dealt to the player as shown in FIG. 1 can be replaced with a single card indicated by the first card replacement indicator highlighted 16, 19, 22, 25, 28 below each card. In this embodiment, each card replacement indicator below represents the number of replacement cards that will appear if the card is discarded. As discussed below in greater detail, only one card of the one or more replacement cards for each card position can be used to replace the discarded card to create the optimum hand. In the play stage shown in FIG. 1, the player has made a base wager and as such, only one replacement card is available for each card position 101-105.

Figure 2:
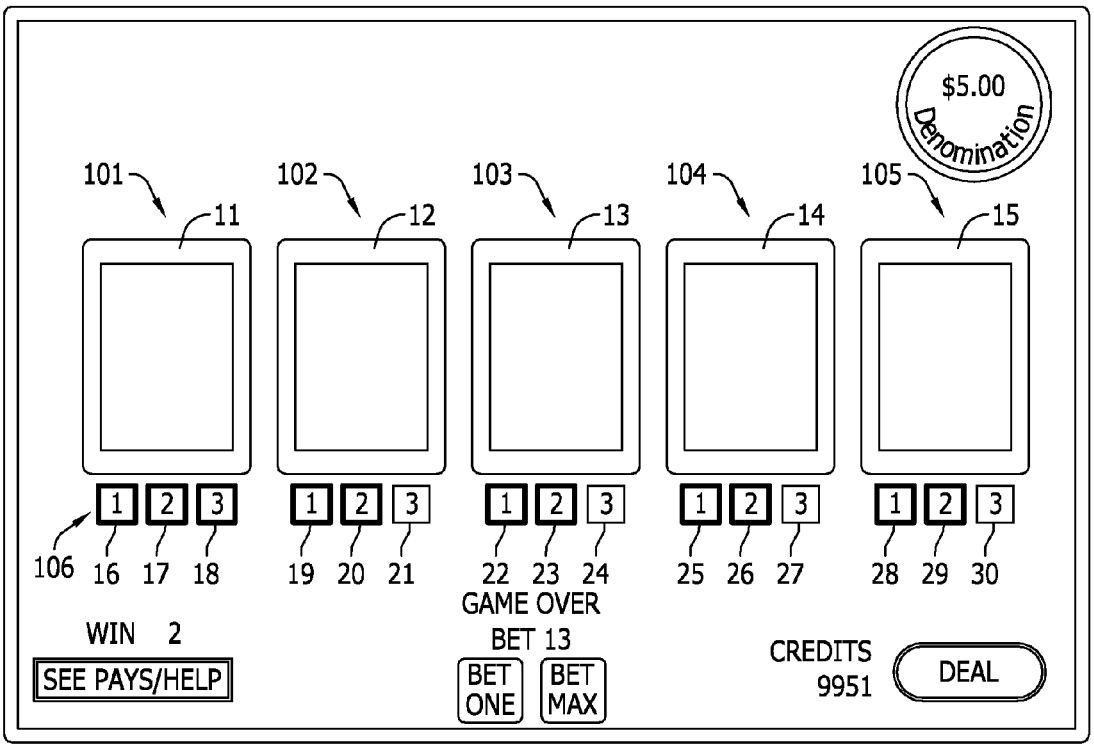
FIG. 2 shows a wager between minimum and maximum and the state of the replacement card indicators with such a wager.

Referring to FIG. 2, as the wager increases by the player wagering additional amount, the number of possible replacement cards for each card position will increase. In this example, card 11 in card position 101, if discarded, will be replaced with three cards as indicated by the replacement indicators 16, 17, 18 as being in a dark background. An optimum hand formed from any one of the three cards replacing card 11 will be used for the final hand. However, the player has not wagered a sufficient amount to receive three replacement cards for the second card position 102. As a result, if card 12 at card position 102, is replaced by the player during game play, then it will be replaced with two cards. Likewise, if card 13 at card position 103, is discarded, it will be replaced with two cards. Card 14, if discarded, will be replaced with two cards as indicated by the darkened replacement indicators 25, 26. Card 15, if discarded, will be replaced with two cards as indicated by the darkened replacement indicators 28, 29.

Thus, card replacement indicators 16, 19, 22, 25, 28 are highlighted indicating that, for the base wager, the player will receive replacement cards for each of the card positions 101-105. In an alternative embodiment, if a one credit wager is made, the player only has the option to replace the card in the first card position 101 while a two credit wager enables the player to obtain a replacement for either the first card position 101 or the second card position 102.

As the wager increases, the number of card replacement indicators will be enabled from left to right. Dark replacement indicators 106 show that a replacement card has been purchased for that card spot and the number of replacement cards purchased for that card spot. In this example embodiment, eleven wagers are shown as being placed at the game stage shown in FIG. 2 because eleven replacement indicators 106 have a dark background. Card 11 has all card replacement indicators 16, 17, 18 enabled (darkened) while cards 12, 13, 14, 15 each have two card replacement indicators enabled. It should be appreciated that other forms of representing the number of possible replacement cards per card position can be used.

Figure 3:
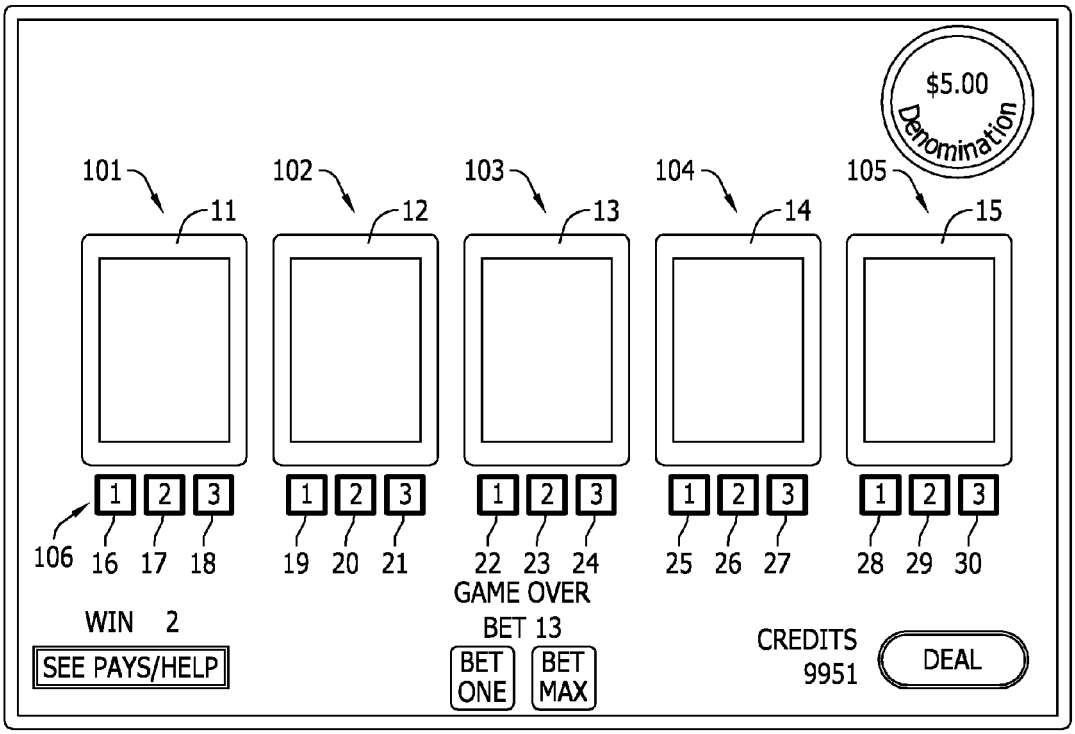
FIG. 3 shows the replacement card indicators at maximum wager.

Referring to FIG. 3, a maximum wager will enable all the card replacement indicators showing that three cards will be shown where one of the replacement cards will be used in place of the discarded card. If none of these cards are held by the player, then all cards 11, 12, 13, 14, 15 will have three additional cards as part of the draw of replacement cards. For each card position, one of the three cards dealt to each respective card position will be selected to make a combination of cards to create the optimum hand.

Figure 4:
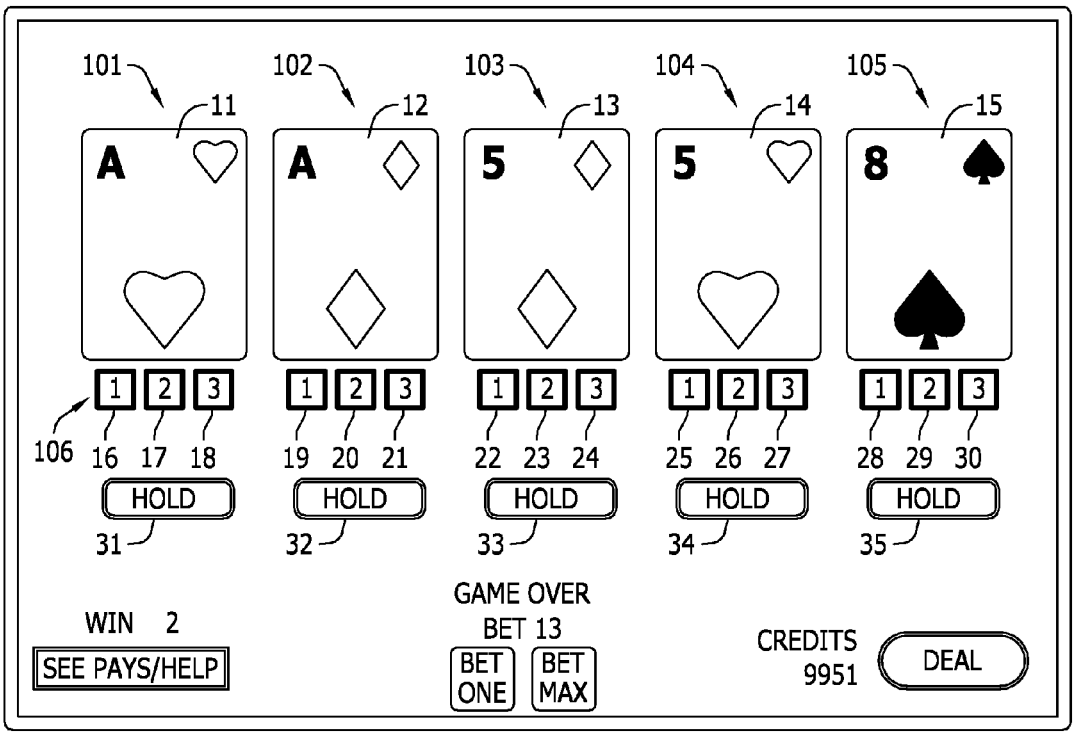
FIG. 4 shows the present invention after the initial deal of the cards.

Referring to FIG. 4, after the initial cards are dealt and the initial wager made by the player, the player is allowed to hold or discard cards 11, 12, 13, 14, 15. This occurs in the traditional manner which can be done using any player interface, such as buttons on a gaming machine, touch screens, mouse clicks, or using a keyboard.

In one embodiment, if the player holds a card, then all possible replacement cards for that card are forfeited and the originally dealt card will be used when the hand is evaluated.

In this example embodiment, all cards are held so the additional purchased cards obtained by additional wagering are forfeited and thus not dealt. And the player's final hand is the hand as originally dealt using cards 11, 12, 13, 14, and 15 shown as two aces, two fives, and an eight.

If, in contrast, the player were to discard cards, then the discarded cards would be replaced with three additional cards such that for each card position, one of the three replacement cards can be used to complete a combination of cards to create an optimum hand. As shown below, the replacement cards may be displayed above in stacked form, above and behind the original card 11, 12, 13, 14, 15 or in other embodiments at other locations or display formats.

Figure 5:
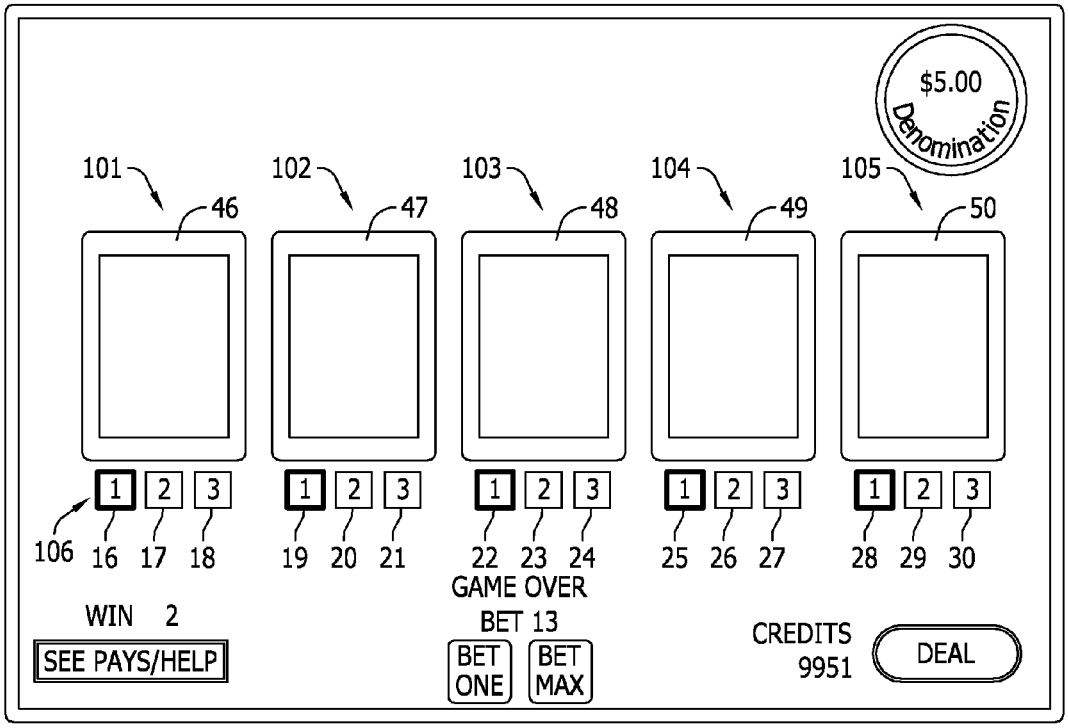
FIG. 5 shows the present invention after the draw using the cards and replacement card indicators in FIG. 1.

Referring again to FIG. 1 if the wagers are placed to allow the player to obtain replacement cards for the cards at card positions 101-105, then the player has the option to replace cards 11, 12, 13, 14, 15. If no cards are held, then all cards will be replaced. As shown in FIG. 5, since no cards are held, the cards 11, 12, 13, 14, 15 shown in FIG. 1 are replaced with the cards 46, 47, 48, 49, 50 as shown in FIG. 5. Each of the replacement cards 46, 47, 48, 49, 50 is used to create the highest value hand.

Figure 6:
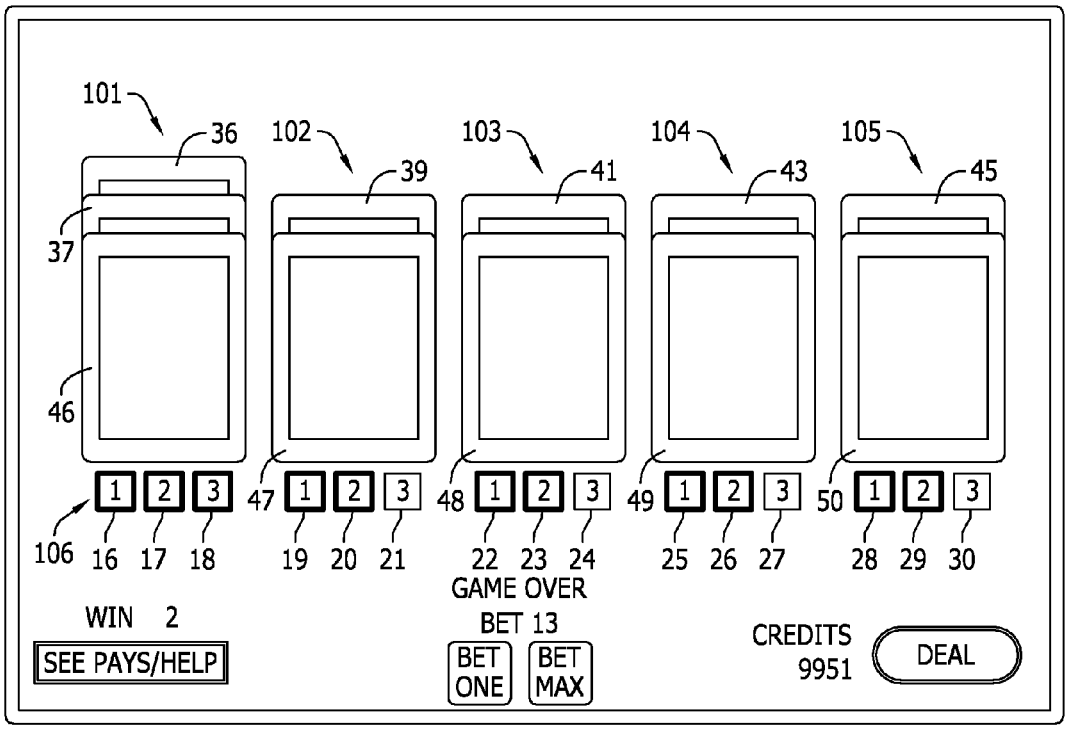
FIG. 6 shows the present invention after the draw using the cards and replacement card indicators in FIG. 2.

Referring to FIG. 6, and using the cards and card indicators from FIG. 2, card 11 at card position 101 is replaced with three cards 36, 37, 46 all of which are at card position 101. Original card 12 is replaced with cards 39, 47, shown at card position 102. Original card 13 is replaced with cards 41, 48 shown at card position 103. Original card 14 is replaced with cards 43, 49 shown at card position 104 and original card 15 is replaced with cards 45, 50 shown at card position 105.

As shown, these replacement cards are displayed to the player above in a stacked matter at the card position 101-105. To make a hand, one card from each card position 101-105 is selected to form a poker hand. The cards may be selected by the gaming machine, or other gaming system, or by the player. The poker hand that may be formed is or should be the highest ranking or highest paying hand as identified on a pay table associated with the game. To form the final hand, any one card from each card position is selected. Thus, one card from cards 36, 37, 46, one card from cards 39, 47, one card from cards 41, 48, one card from cards 43, 49, and one card from cards 45, 50 is used to create the highest value hand. Of all the combinations created by the individual cards of each position, only the combination of cards that yields the highest value hand is awarded to the player. A pay table is used to determine if the resulting highest value hand is a winning outcome and is thus entitled to an award.

Figure 7:
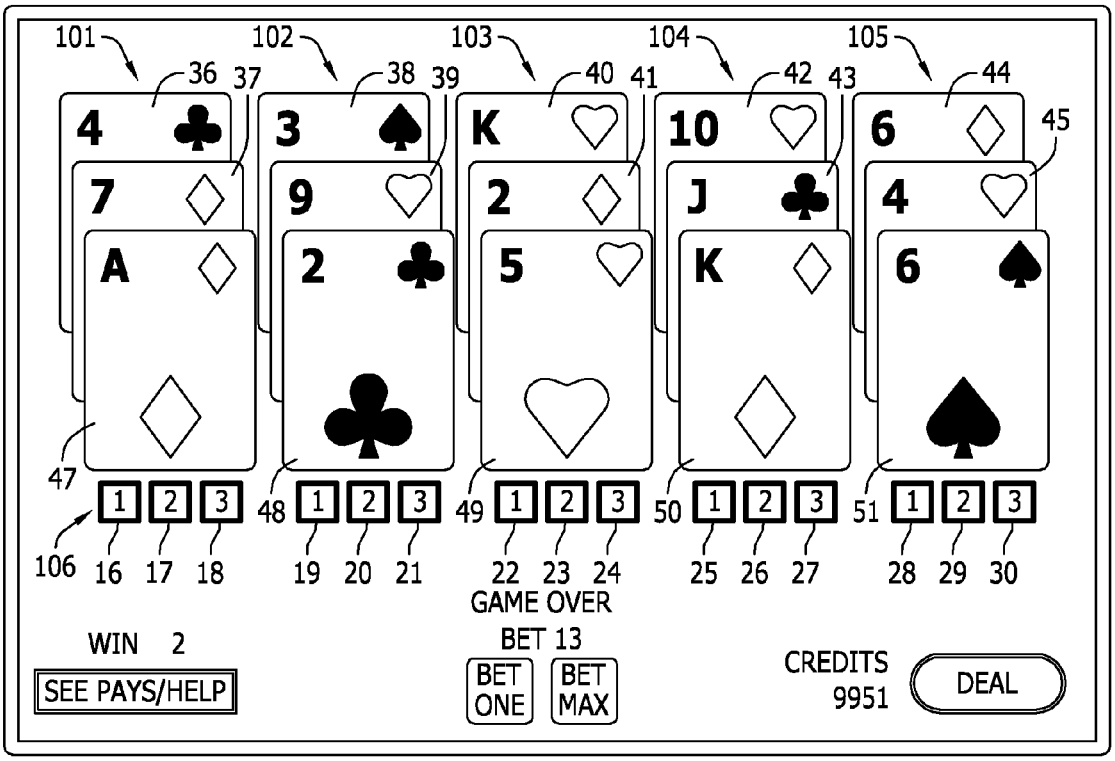
FIG. 7 shows the present invention after the draw using the cards and replacement card indicators in FIG. 3.

Referring to FIG. 7, when none of the initial cards dealt to the player are held, and all replacement cards are visible when the draw occurs. Hence, new cards populate all the card positions 101-105. In this example embodiment, the player wagered the maximum wager as indicated by the darkened replacement indicators 106. For example the first position, the replacement indicators 16, 17, and 18 are darkened. As a result, the player is able to receive three replacement cards replacements for each card position 101-105. The combination of one card from each of the visible replacement cards at each respective card position is used to create the optimum hand. The exemplary replacement cards are in FIG. 7 that the highest hand would be two pair formed by selecting the four of clubs (card 36) from the first card position 101, any card from the second card position 102, the king of hearts (card 40) from the third card position 103, the king of diamonds (card 50) from the fourth card position 104 and the four of hearts (card 45) from the fifth card position. This results in two pair (kings and four). The pair of sixes could not be taken from the fifth card position 105 because only one card may be selected from each card position.

It should be further clarified that the method of determining the highest value hand is from (a) evaluating every possible combination of five cards using one card from each of the one or more replacement cards from each respective card position and (b) each held card at its respective position.

It is also contemplated that as the player wagers additional wagers, which result in additional cards being dealt to the player may result in a change in the pay table. For example, if the player wagers more to obtain additional cards, the paytable may increase the payout amount to reflect the larger wager, or the paytable may provide for a lower payout due to the fact that the player is increasing their chance of receiving a winning hand by obtaining additional cards. In one embodiment, the payback percentage is the same for all wagers. Likewise, the ranking of hands may change depending on the amount wagered, and hence the number of cards to be received. For example, if the player receives the maximum number of cards, then receiving a pair is highly likely or guaranteed. Hence, that hand rank may not result in a payout or if a payout is provided, a reduced payout.

Figure 9A:
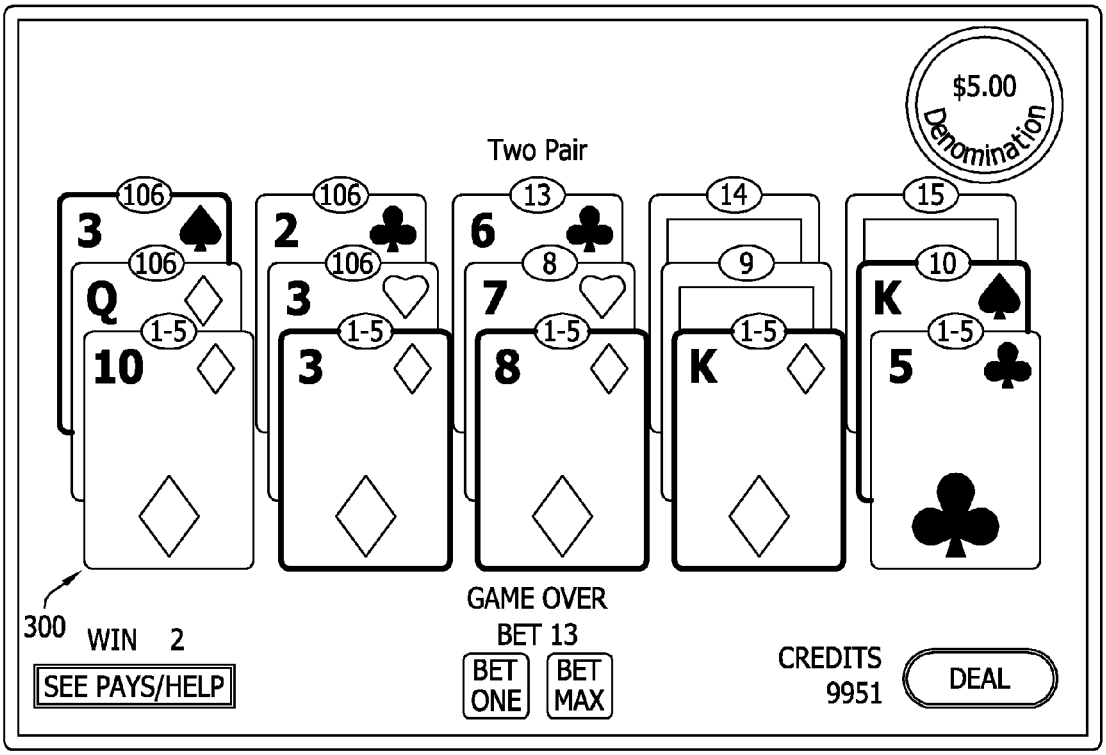
FIGS. 9A & 9B illustrate exemplary card indicator display methods.

It is also contemplated that alternative replacement indicators 106 may be utilized as shown in FIG. 9A. Instead of the replacement indicators 106 lined up under the dealt card as shown above, the replacement indicators 106 may be applied to the individual card as shown at the top center of each card. The highlighting of the area in the replacement indicators 106 operates similar to that shown in the prior figures, but in this embodiment it allows providing the player and operator (in cases of dispute) more information as to what happened when the player wagered/held/and won/loss. In this embodiment, the first wager entitles the player replacement cards for the first 1-5 card position 300.

In one example embodiment, there are four states for each marker on each card:

1. Black background/White text=No Wager
2. White background/Black text=Wager applied
3. Red background/White text=Wager with Win involving card (additionally the card gets a red highlight around it)
4. Yellow background/Black text=Card held after deal (meaning player forfeits all replacement cards for that card).

The yellow/black "9" in this case indicates that the player held the K-Diamond so that "9" card was never flipped over. The Black/White "14" shows that the player never placed a wager to activate that card.

Figure 9B:
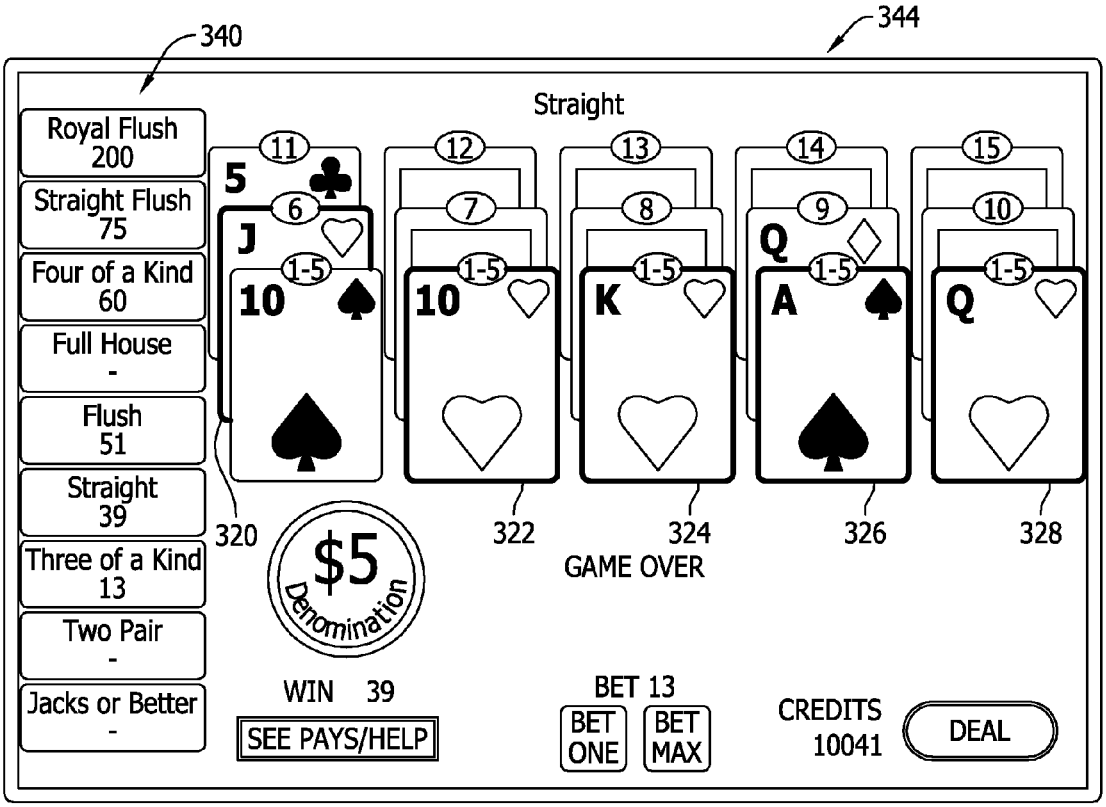

FIG. 9B illustrates an example game display with card indicator showing which cards are used to form the final combination of cards. In this embodiment, cards 320, 322, 324, 326, 328 are shown with highlighting around the outer edge of the card to indicate these are the cards used to form the final hand which is then compared to the pay table. A paytable 340, may be shown on the screen 344.

In one embodiment, the replacement cards are analyzed to initiate a bonus event responsive to the replacement cards being located at a specific card location. An example would be if three replacement cards shown at a specific card position created a straight, a straight flush, a flush, or three of a kind where the combination is determined to initiate a bonus event or a bonus award paid to the player The pay table may be based on traditional poker hand arrangements and rankings, or card arrangements and rankings which differ from traditional poker hands.

Exemplary traditional poker hands are defined as follows. A poker hand may consist of five cards. Even though in some variants you may have more than five cards to choose from, you select the five cards that make the best hand, and for the purpose of comparing hands any other cards are irrelevant.

The ranking of hands from high to low in standard poker is as follows. Straight Flush—Five consecutive cards of the same suit. Ace can be counted as high to make the highest type of Straight Flush, which is A-K-Q-J-10 of a suit, sometimes known as a Royal Flush. Ace can be low to make (5-4-3-2-A), but not high and low at the same time (for example 2-A-K-Q-J is not valid).

Four of a Kind—Four cards of the same rank and one other card, such as 9-9-9-9-Q. Four of a kind are sometimes known as quads or in some non-English speaking countries as a poker. The odd card—the queen in the example—is called the kicker.

Full House—Three cards of the same rank plus a pair of cards of another rank, such as 5-5-5-K-K, which would be described as "fives full of kings". A full house is sometimes known as a boat.

Flush—A flush consists of five cards of the same suit (not all consecutive, otherwise it would be a straight flush).

Straight—Five cards of consecutive ranks, not all of the same suit. The highest is A-K-Q-J-10 and an Ace can instead be counted as low to make the lowest straight 5-4-3-2-A, which is sometimes called a wheel. An Ace cannot be in the interior of a straight—for example 4-3-2-A-K is not a straight.

Three of a Kind—Three cards of the same rank and two cards of different ranks, for example 7-7-7-10-6, for a three of a kind hand. This is sometimes known as a triplet or trips.

Two Pair—Two cards of one rank, two cards of a second rank and one card of a third rank (the kicker)—for example J-J-3-3-8.

Pair—Two cards of equal rank and three cards of different ranks—for example Q-Q-A-8-7.

Nothing—A hand which does not fit any of the categories above, commonly known as High Card or sometimes No Pair. That is: five cards of different ranks, not all consecutive and not all the same suit. Any hand of a higher type beats any hand of a lower type. When comparing two hands of the same type, the ranking is determined by the ranks of the individual cards. The most numerous rank of cards in each hand (the quad, the triplet in a full house or trips, otherwise the pair if any) is compared first; if these are equal, any less numerous ranks are compared. When two ranks are equally numerous, the highest-ranking cards are compared before the others. In standard poker the four suits are all equal, and that poker hands consist of five cards only. Therefore if two players can make five-card hands that are equal apart from the suits of the cards, there is a tie and if necessary they share the winnings equally.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games. In a preferred embodiment, the methods of game play and presentation are implemented via a gaming machine or device 222. Such a gaming machine 222 may have various configurations.

The gaming machine 222 may be located at a casino (and as such is referred to as a "casino gaming machine"). As described below, the gaming machine 222 may be part of a gaming system, such as a casino gaming system which links multiple of the gaming machines, one or more table games and other devices such as kiosks, accounting systems or servers, progressive systems or servers, player tracking systems or servers or the like. The gaming machine may be networked such that one or more game events occur on a remote server and player input and server activity are exchanged over the network. This may be referred to as server based gaming.

Figure 8:
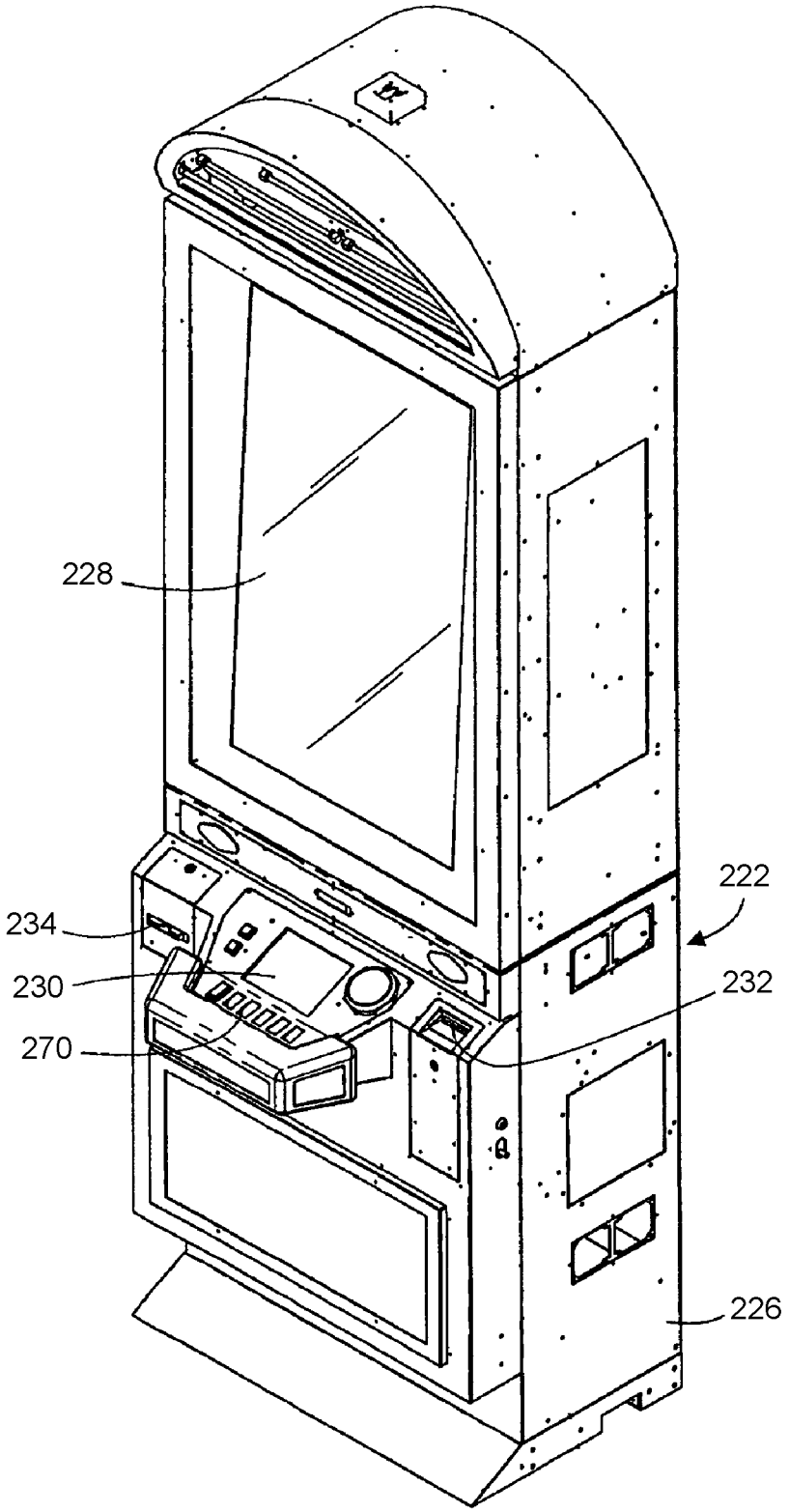
FIG. 8 shows an exemplary gaming machine.

One configuration of a gaming machine 222 is illustrated in FIG. 8. As illustrated, the gaming machine 222 generally comprises a housing or cabinet 226 for supporting and/or enclosing various components required for operation of the gaming machine. In the embodiment illustrated, the housing 226 includes a door located at a front thereof, the door capable of being moved between an open position which allows access to the interior, and a closed position in which access to the interior is generally prevented. The configuration of the gaming machine 222 may vary. In the embodiment illustrated, the gaming machine 222 has an "upright" configuration. However, the gaming machine 222 could have other configurations, shapes or dimensions (such as being of a "slant"-type, "bar-top" or other configuration as is well known to those of skill in the art).

The gaming machine 222 preferably includes at least one display device 228 configured to display game information. The display device 228 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 228 may be capable of projecting or displaying a wide variety of information, including images, symbols and other indicia or information associated with game play, game promotion or other events.

As described in more detail below, the gaming machine 222 is preferably configured to present one or more games upon a player making a monetary payment or wager. In this regard, as described in more detail below, the gaming machine 222 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 222 includes means for returning unused monetary funds and/or dispensing winnings to a player.

The gaming machine 222 preferably includes one or more player input devices 230 (such as input buttons, plunger mechanisms, a touch-screen display, joystick, touch-pad or the like). These one or more devices 230 may be utilized by the player to facilitate game play, such as by providing input or instruction to the gaming machine 222. For example, such input devices 30 may be utilized by a player to place a wager, cause the gaming machine 222 to initiate a game, to indicate cards to be held or discarded, to "cash out" of the gaming machine, or to provide various other inputs.

In one preferred embodiment, the gaming machine 222 includes at least one microprocessor or controller for controlling the gaming machine, including receiving player input and sending output signals for controlling the various components of the machine 222 (such as generating game information for display by the display 228). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 228 (such as information representing images of displayed cards), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 222 may also include one or more random number generators for generating random numbers, such as for use in selecting cards and for presenting the game in a random fashion.

Preferably, the controller is configured to execute machine readable code or instructions which are configured to implement the method of game play of the invention. For example, the controller of the gaming machine 222 may be configured to detect a wager, such as a signal from a player's depressing of the "bet one" button. Upon such an event and/or the player otherwise signaling the gaming machine to present the game, the controller may be configured to cause the wagering game described herein to be displayed on the at least one display 228. The controller may accept input from a player of the game via the one or more player input devices of the gaming machine 222.

The gaming machine 222 may be configured to generate and present games in a stand-alone manner or it may be in communication with one or more external devices at one or more times. For example, the gaming machine 222 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 222 is configured to present one or more wagering games. Thus, the gaming machine 222 is preferably configured to accept value, such as in the form of coins, tokens, paper currency or other elements or devices representing value such as monetary funds. For example, the gaming machine 222 might include a coin acceptor 232 for accepting coins. Of course, associated coin reading/verifying devices and coin storage devices may be associated with the gaming machine 222 if it is configured to accept coins. Likewise, the gaming machine 222 might include a media reader 234. Such a reader may be configured to accept and read/verify paper currency and/or other media such as tickets. Of course, in such event the gaming machine 222 may further be configured with one or more paper currency or ticket storage devices, such as cash boxes, and other paper currency or media handling devices (including transport devices).

The gaming machine 222 might also be configured to read FOBs, magnetic stripe cards or other media having data associated therewith and via which value or funds may be associated with the gaming machine 222.

In one embodiment, the gaming machine 222 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 222 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 222 may also include a player tracking device, such as a card reader and associated keypad 270. Such player tracking devices are well known and may permit the game operator to track play of players of the gaming machine. The tracked play may be utilized to offer player bonuses or awards.

It will be appreciated that the gaming machine illustrated in FIG. 1 is only exemplary of one embodiment of a gaming machine. For example, it is possible for the gaming machine to have various other configurations, including different shapes and styles and having different components than as just described.

Another possible example is for the game of the invention to be presented on a computing device, including at a home or office computer. In one embodiment, a player might log in to a casino server and the controller of the casino server may cause game information to be delivered to the player's computer and then be displayed on a display of the player's computer. In this regard, it will be noted that the term "controller" may comprise more than one device. For example, in a server-based environment, a controller at a server may generate game information and transmit that information to a local controller at a gaming machine. The local controller at the gaming machine may then cause game information to be displayed on the gaming machine display. The games of the invention could also be presented by or at hand-held devices, such as PDAs, cellular phones, tablet computing devices or the like.

A casino may have numerous gaming machines 222, located on a casino floor or in other locations. Of course, such gaming machines 222 might be used in other environments, such as in airport, a bar or tavern or other locations.

Mobile Gaming, Online Gaming and Networked Gaming

It is also contemplated that the game disclosed herein may be played on a personal computer, mobile device, or online. A processor can execute machine readable code stored on a memory (such as software) to enable the game steps disclosed herein. The player would interact with the gaming machine or computer to provide player input. Based on wager amounts and final player hand a payout may be made to the player. On-line play may occur over a computer network The game disclosed herein may be used in a mobile or networked gaming system for use with the gaming terminal or mobile device that are remote from a server. In such an embodiment, the gaming system includes the gaming terminal. When used in a mobile device, the mobile device will have a transceiver, processor and display capable of receiving signals that are representative of game information from the gaming server and displaying the information and graphics to a player.

The user will interact with the mobile device to play games or otherwise manipulate the contents of the display. In one embodiment, the user may use one or more input devices to communicate with the gaming server. Such input devices may be integral to the mobile device (such as a dedicated keypad or the like), may be devices which can be selectively coupled to the mobile device. In one preferred embodiment, a mobile device is configured to communicate with the gaming server. In some embodiments, the mobile device is a smart phone or tablet programmed to communicate with the gaming server. In some embodiments, the mobile device is a dedicated gaming controller configured to interact with a gaming server or terminal. The mobile device may include a software component, such as a mobile software application that can be downloaded to the player's mobile device, that facilitates the interaction with the gaming server. Alternatively or additionally, the mobile device may use a web browser or similar component to interact with the gaming server.

The mobile device may be networked or otherwise communicatively coupled with the gaming server using any known or future developed communication link that may be wired or wireless such as cellular, bluetooth, WiFi, etc. The communication link is generally two-way. As a two-way communication channel, the gaming server may receive inputs from the mobile device (e.g., from a keyboard or touch screen) and send outputs to the mobile device for display to the user (e.g., to a display or touch screen). In the exemplary embodiment, the gaming server is communicatively coupled with a network. The network may be coupled to a casino system, which may be similar to casino game server. The casino system may include a player loyalty or user account system.

The mobile device is programmed to send inputs to the gaming server in order to manipulate any games being played on the gaming server. More particularly, the gaming server may provide input options to the mobile device for selection by the player. For example, the gaming server may cause buttons to appear on the touch screen of the mobile device. During a video poker game as described herein the buttons may be HOLD, DRAW, MAX BET, etc. buttons.

It is contemplated that a plurality of mobile devices may be used with the gaming server. Using more than one mobile device, two or more players may participate in the game. During operation, the user may play a game using the gaming server and the mobile device. The identifying information may be a username and password or other credentials that enable the game server to authenticate the user and associate the user with a user account. The player may have a plurality of credits that the user can use during wagering games. Once the player is logged in to the gaming server, the user may selectively resume previous games (e.g., games played previously on the same game terminal or elsewhere, such as in the casino) or commence a new game. The user may select from one or more games made available by one or more vendor game servers 530.

It is also contemplated that the game described herein could be implemented for tournament play whereby numerous gaming machines are linked or other associated, such as in a common room. Players may then wager in a competition against other players and each player's play, including credits won, credits lost, and play through is tracked. Based on one or more of each player's won credits, lost credits, and play through.

Figure 10:
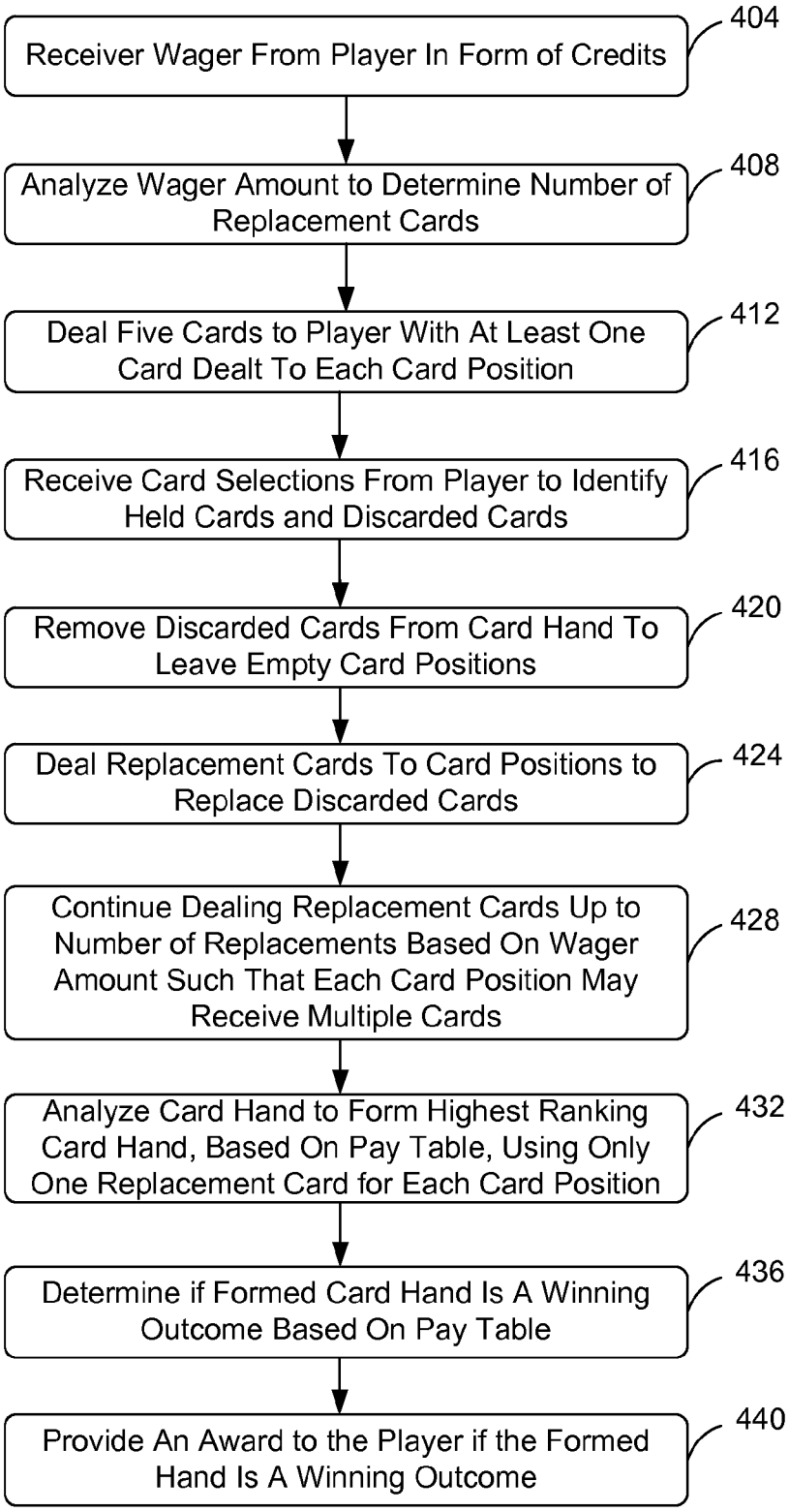
FIG. 10 illustrates a flow chart of an example of method of play.

While other methods of play are possible, FIG. 10 is an exemplary flow diagram of one possible method of play. At a step 404, the play is commenced by the gaming machine or other system or entity offering the game receiving a wager from the player. The wager may be in the form of tokens, credits, coins, or bills, such as paper money. At a step 408, the wager amount is analyzed to determine the number of replacement cards which will be dealt. The larger the wager, or the greater number of credits which are waged, the more replacement cards are dealt, such that two or more replacement cards may be dealt to each card position.

At a step 412, the system deals one card to each card position. These cards may be defined as original cards since these cards are the original cards dealt to a hand.

In another embodiment, the amount of the wager determines how many cards are initially dealt, such that if the initial wager is larger than the base wager, or larger than a threshold, more than one card is dealt to each card position. The player would then select which of the originally dealt cards to hold, such that the card positions having been dealt two or more cards, would also select which of the multiple cards at a card position to hold, hence dealing multiple original cards to each card. If the player elects to discard all of the original cards dealt to a card position, the cards at a particular card position could be discarded, and as discussed below, replacement cards would be dealt to that card position. This is in contrast to traditional draw poker, which only deals one original card to each card position.

At a step 416, the system receives card selections from player to identify held cards and discarded cards. This occurs in the traditional manner such as by the player pressing buttons or using a touch screen to indicate which cards to hold and which cards to discard. At a step 420, the system removes discarded cards from the card hand to leave empty card positions. At these empty card positions, additional cards are dealt at a step 424. Thus, the system deals replacement cards to card positions where the original cards were discarded.

At a step 428, the system continues dealing replacement cards up to the number of replacements based on wager amount such that each card position may receive multiple cards. This is in contrast to traditional draw poker, which only deals one replacement card to each card position.

At a step 432, the system analyzes the card hand to form a highest ranking card hand, based on pay table, using only one replacement card for each card position. In contrast to the prior art draw poker, which only deals one replacement card to each card position at which a card was discarded, this method of play deals more than one card. In one embodiment, the player may wager additional amount to obtain additional replacement cards. In other embodiments, the player may be provided more than one replacement card for a particular card position for the only base wager. Thus, no additional wager is required in this example embodiment.

At a step 436, the system determines if the formed card hand is a winning outcome based on pay table. This occurs by processing the various combinations of possible card hand by selecting only one card from each card position. A best or highest card hand is formed using this process. The highest card hand or hand rankings may follow traditional poker hand rankings or be based on different ranking which are developed based on the use of multiple replacement cards, which can affect which card hand are more or less likely to obtain during play.

At a step 440, the system provides an award to the player if a formed card hand from step 436 is a winning outcome. Typically, the pay table defines the card hands which are winning outcomes.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method of playing a game at a gaming machine comprising the machine-implemented steps of:

providing a gaming machine, gaming machine including a gaming machine display, a player interface, a bill or ticket acceptor, a memory storing non-transitory machine-readable code, and a processor configured to execute the machine readable code to perform one or more of the following steps of the method:

receiving a wager with a bill or ticket acceptor that is part of the gaming machine, the wager having an amount;

displaying dealt playing cards, the playing cards displayed to the player on the gaming machine display to create a first card set such that one card is dealt and displayed at each card position;

receiving input from the player via the player interface that is part of the gaming machine regarding which cards to discard from the first card set;

displaying on the gaming machine display a second card set of replacement cards to replace discarded cards;

to each card position that contains a discarded card, displaying one or more replacement cards instead of the first card set card such that the number of replacement cards displayed at the card position corresponds to the amount of the wager such that multiple cards may be displayed at each card position;

calculating a hand rank based on an arrangement of cards that results in the highest possible hand rank based on two or more hand ranks set forth in a pay table, such that the arrangement of cards includes only one card from each card position which may include non-discarded cards from the first card set and replacement cards;

providing an award to the player if the hand rank achieved by the player is a winning hand rank based on the pay table the award presented to the player by the gaming machine as a monetary payout or a ticket.

2. The method of claim 1 wherein displaying cards includes dealing and displaying five cards.

3. The method of claim 2 wherein the first card set includes five card positions and one of the five cards is displayed at each of the five card positions.

4. The method of claim 3 wherein up to three replacement cards may be displayed at each card position to replace discarded cards.

5. The method of claim 1 wherein each wager amount is a credit and each credit wagered results in one replacement card being displayed as a replacement card.

6. The method of claim 1 wherein the highest possible hand rank is based on traditional poker hand ranks.

7. The method of claim 1 further comprising analyzing the replacement cards to determine if the replacement cards result in a bonus outcome and if the replacement cards result in a bonus outcome, providing a bonus award to the player.

8. A gaming machine comprising:

a controller;

at least one electronic display associated with the gaming machine configured to display a wagering game to at least one player;

at least one player input device associated with the gaming machine;

a wager acceptor configured to receive a ticket or monetary value from a player;

a memory storing machine-readable code, the machine-readable code executable by the controller to present a base game at the gaming machine, the base game including the following steps:

receive a base game wager at the gaming machine on the base game, an amount of the base game wager determining the total number of replacement cards to replace discarded cards during the base game, such that an incremental increase in the wager results in one additional card, and additional wager increments results in additional replacement cards;

display five original cards for use by the player during the base game and displaying the original cards on the electronic display to the player, the original cards displayed on the electronic display at card positions;

during the base game, receive an indication from the player via the player input device regarding which original cards are held or which original cards are discarded;

during the base game, display on the electronic display a set of replacement cards, the replacement cards set containing replacement cards used to replace the discarded original cards;

on the display, replace discarded cards with replacement cards that are selected from the set of replacement cards, the total number of possible replacement cards displayed at card position controlled by the amount of the base game wager and the replacing including displaying at least two replacement cards to at least one card position;

form a single highest ranking hand from any original cards and replacement cards displayed on the electronic display during the base game such that only one card from each card position may be selected when forming the single highest ranking hand;

compare the single highest ranking hand to a pay table to determine if the single highest ranking hand is a winning outcome; and if the single highest ranking hand is a winning outcome, provide an award to the player as part of the base game.

9. The method of claim 8, wherein form the single-highest ranking hand includes receiving input from the player regarding which cards to select for the hand.

10. The method of claim 8, further comprising analyzing the replacement cards to initiate a bonus event responsive to the replacement cards being located at a specific card position.

11. The method of claim 10, wherein the combination of replacement cards shown at card positions on the electronic display can initiate a bonus event that is in addition to the base game.

12. The method of claim 8, wherein the single highest ranking hand does not correlate to the highest value hand in traditional poker ranking.

13. The method of claim 12, wherein the single highest hand value is determined by the number of suits in the hand, or the total sum of the card values.

* * * * *